United States Patent [19]

Elkins

[11] 4,265,307

[45] May 5, 1981

[54] SHALE OIL RECOVERY

[75] Inventor: Lincoln F. Elkins, Oklahoma City, Okla.

[73] Assignee: The Standard Oil Company, Cleveland, Ohio

[21] Appl. No.: 971,452

[22] Filed: Dec. 20, 1978

[51] Int. Cl.[3] ..... E21B 43/24; E21B 43/247; E21B 43/263

[52] U.S. Cl. ..... 166/248; 166/50; 166/60; 166/65 R; 166/259; 299/2

[58] Field of Search ..... 166/248, 60, 65 R, 271, 166/272, 299, 302, 259, 50; 299/2

[56] References Cited

U.S. PATENT DOCUMENTS

| | | | |
|---|---|---|---|
| 1,269,747 | 6/1918 | Rogers | 299/14 X |
| 2,685,930 | 8/1954 | Albaugh | 166/248 UX |
| 2,757,738 | 8/1956 | Ritchey | 166/248 |
| 3,223,158 | 12/1965 | Baker | 166/259 |
| 3,586,377 | 6/1971 | Ellington | 166/259 X |
| 4,135,579 | 1/1979 | Rowland et al. | 166/248 |
| 4,140,179 | 2/1979 | Kasevich et al. | 166/60 X |
| 4,144,935 | 3/1979 | Bridges et al. | 166/248 |

FOREIGN PATENT DOCUMENTS

| | | | |
|---|---|---|---|
| 2427031 | 12/1975 | Fed. Rep. of Germany | 166/248 |

*Primary Examiner*—Stephen J. Novosad
*Attorney, Agent, or Firm*—John E. Miller, Jr.; Herbert D. Knudsen; Larry W. Evans

[57] ABSTRACT

In situ shale oil recovery from oil shale deposits using radio frequency energy as a heat generator is facilitated by rubblizing the shale oil deposits before application of radio frequency energy.

27 Claims, 3 Drawing Figures

SHALE OIL RECOVERY

BACKGROUND OF THE INVENTION

The present invention relates to an improved technique for recovering shale oil from oil shale.

Shale oil is composed of inorganic matter (rock) and organic matter called kerogen. As is well known, when oil shale is heated (retorted) at elevated temperatures on the order of 600° F. to 900° F. in the absence of significant oxygen, kerogen is destructively distilled (pyrolyzed) to form a hydrocarbon gas, shale oil and carbon. The shale oil being at elevated temperature is in the vapor phase while the carbon is in the form of coke. Continued heating of shale oil will cause decomposition to form more gas and more coke.

A compilation of recent studies have shown that the yield of shale oil possible from retorting oil shale is dependent upon a number of variables. In particular, it has been found that the yield of shale oil will be maximized if the following four criteria are met:

(1) retorting is accomplished at low pressures, preferably on the order of 1 atmosphere pressure;

(2) the oil shale is heated-up from ambient to maximum temperature during retorting as quickly as possible;

(3) the maximum temperature during retorting is on the order of 800° F. to 900° F. (425° C. to 485° C.); and (4) the shale oil obtained from the decomposition of kerogen is removed from the oil shale and cooled as quickly as possible. For more thorough information on the pyrolysis of oil shale, see Wise, et al., A LABORATORY STUDY OF GREEN RIVER OIL SHALE RETORTING UNDER PRESSURE IN A NITROGEN ATMOSPHERE, The Laramie Energy Research Center, Energy Research and Development Administration, Laramie, Wyo. LERC/TPR-76/1; Bae, SOME EFFECTS OF PRESSURE ON OIL-SHALE RETORTING, Society of Petroleum Engineers Journal, Sept. 1969; Campbell, et al., DYNAMICS OF OIL GENERATION AND DEGRADATION DURING RETORTING OF OIL SHALE BLOCKS AND POWDERS, from the Proceedings of the Tenth Oil Shale Symposium, Colorado School of Mines, Apr. 1977; and Needham, OIL YIELD AND QUALITY FROM SIMULATED IN-SITU RETORTING OF GREEN RIVER OIL SHALE, 51st Annual Fall Technical Conference and Exhibition of the Society of Petroleum Engineers of AIME, Oct. 1976 SPE 6069.

Beginning in the 1920's, numerous techniques have been proposed for processing oil shale in situ to recover shale oil therefrom. The first such proposal, referred to as "true in situ combustion retorting", involved the in situ retorting of the oil shale. Heat necessary for retorting was to be supplied by in situ combustion, combustion being accomplished along a combustion front which moved from one end of the bed to the other during the retorting operation.

The true in situ combustion retorting technique was first tried in the 1950's and was attempted a number of times in the 1950's and the 1960's. In carrying out this process, small fissures were introduced into the oil shale bed by hydrofrac techniques prior to retorting in order to expedite the passage of vaporous shale oil out of the bed being processed. Unfortunately, the true in situ combustion retorting technique was not successful.

In the early 1970's, a modification of the true in situ combustion retorting technique was first tried. This technique, referred to as the "modified in situ combustion retorting technique" differs from the true in situ combustion retorting technique in that prior to retorting, partial mining around the bed is accomplished to provide a greater flow path for the escape of the shale oil. Also prior to retorting, the shale oil bed is broken up or fragmentized (referred as "rubblized") into chunks or pieces, this usually being accomplished by means of explosives.

In practice it was found that the modified in situ combustion retorting technique was able to recover shale oil in amounts as high as 60% of theoretical yield when practiced on beds on the order of 65,000 to 140,000 cubic feet. However, when tried on beds on the order of 4 million cubic feet, yields dropped off to around 30% of theoretical. Although the exact reason for this is not known, it is theorized that this low conversion was due to the fact that the fire went out in various spots in the combustion zone as it moved through the bed, which in turn was due to the significant variations in the kerogen content in oil shale. Increasing non-uniformity of fragmentation of the oil shale with increasing bed size is also believed to contribute to the low yields obtained.

In addition to combustion retorting, other techniques have been proposed for the recovery of shale oil from oil shale by the in situ retorting of oil shale. Many of these techniques are based on utilization of electrical energy for heating of the oil shale. Heat generation through induction heating of electrodes, induction heating of the oil shale itself and heating through the application of VHF and UHF energy have all been proposed. These various techniques as well as the disadvantages associated therewith are summarized in U.S. Pat. No. 4,144,935.

Still another method for the in situ recovery of shale oil from oil shale was proposed in the mid-1970's. This technique is an offshoot of the true in situ combustion retorting technique and uses radio frequency energy rather than combustion to furnish the heat necessary for retorting. In accordance with this technique, a grid of electrodes is arranged to bound (in an electrical sense) the bed to be retorted on at least two sides and radio frequency energy applied to the grid to cause dielectric heating of the kerogen in much the same way as a microwave oven heats its contents.

This technique (known as the IITRI technique for the assignee thereof, Illinois Institute of Technology Research Institute) appears to have many advantages over the above-mentioned techniques. Regarding previously proposed techniques based on the use of electrical energy, the IITRI technique appears to be much more efficient. Regarding in situ combustion techniques, the IITRI technique avoids the use of a combustion front and hence the various disadvantages associated with a combustion front particularly the possibility of oxygen coming into contact with shale oil vapors, are also avoided.

The IITRI technique, however, has not as yet been reduced to practice. It has, however, been shown in the laboratory on an extremely small sample of oil shale that shale oil can be recovered using radio frequency energy.

Although the IITRI technique appears to be theoretically possible, it is believed that the maximum possible yields of shale oil possible when using this technique will not be as great as expected. Accordingly, it is an object of the present invention to provide a modification of the IITRI technique which will allow shale oil to be recovered in greater amounts than possible in accordance with the presently proposed IITRI process and will allow the IITRI process to be practiced at reasonable cost effectiveness.

SUMMARY OF THE INVENTION

This and other objects are accomplished by the present invention in accordance with which the shale oil bed to be processed in accordance with the IITRI technique is rubblized before the application of radio frequency energy. By carrying out the IITRI process on a shale oil bed which is rubblized, retorting is accomplished in a manner which, because of the properties of oil shale, favors the recovery of shale oil in higher yields than otherwise would be possible.

Thus, the present invention provides an improvement in the known process for recovering shale oil from a bed of oil shale in which the bed of oil shale is heated in situ to cause destructive distillation of the kerogen therein by the application of radio frequency energy thereto and the shale oil produced thereby recovered from the bed, the improvement in accordance with the present invention wherein the oil shale bed is rubblized when said radio frequency energy is applied thereto.

In a boarder sense, the present invention provides an improvement in the known process for recovering a hydrocarbonaceous product from a solid, non-freeflowing hydrocarbonaceous earth formation in which a bed of the hydrocarbonaceous formation is heated in situ to cause destructive distillation of hydrocarbonaceous material therein to form the hydrocarbonaceous product, heating of the bed being accomplished by introducing electrical excitation into the bed to establish alternating electric fields in the bed, the alternating electric fields being substantially non-radiating and being substantially confined in the bed whereby dielectric heating of the bed occurs, the improvement in accordance with the invention wherein the bed is rubblized when the alternating electric fields are applied thereto.

In a particular embodiment of the invention, a hydrocarbonaceous formation such as an oil shale formation which as a practical matter is too big to be processed all at once can be processed in segments very simply and easily. In this instance, the present invention provides a novel process for recovering, for example, shale oil from an oil shale formation defining a plurality of oil shale beds, the process comprising: (1) rubblizing a first oil shale bed; (2) thereafter heating the first oil shale bed in situ to cause destructive distillation of kerogen therein and the generation of vaporous shale oil, heating of the first shale oil bed being at least partially accomplished by applying radio frequency energy thereto; (3) recovering vaporous shale oil from the first shale oil bed; (4) rubblizing a second shale oil bed; (5) after step (2), transferring sensible heat in the first shale oil bed to the second shale oil bed by forced convection; and (6) heating the second shale oil body in situ by the application of radio frequency energy thereto to cause destructive distillation of the kerogen therein and the generation of additional vaporous shale oil.

Finally, the present invention also provides a system for in situ heat processing of hydrocarbonaceous earth formations, this system comprising conductive means inserted in the formation and bounding a particular bed of the formation on at least two sides thereof; electrical excitation means for establishing alternating electric fields in the bed, the frequency of the excitation means being selected as a function of the bed dimensions so as to establish substantially non-radiating electric fields which are substantially confined in the bed whereby volumetric dielectric heating of the formations will occur to effect approximately uniform heating of the bed; and means for rubblizing the bed in situ.

DETAILED DESCRIPTION

Figure 1:
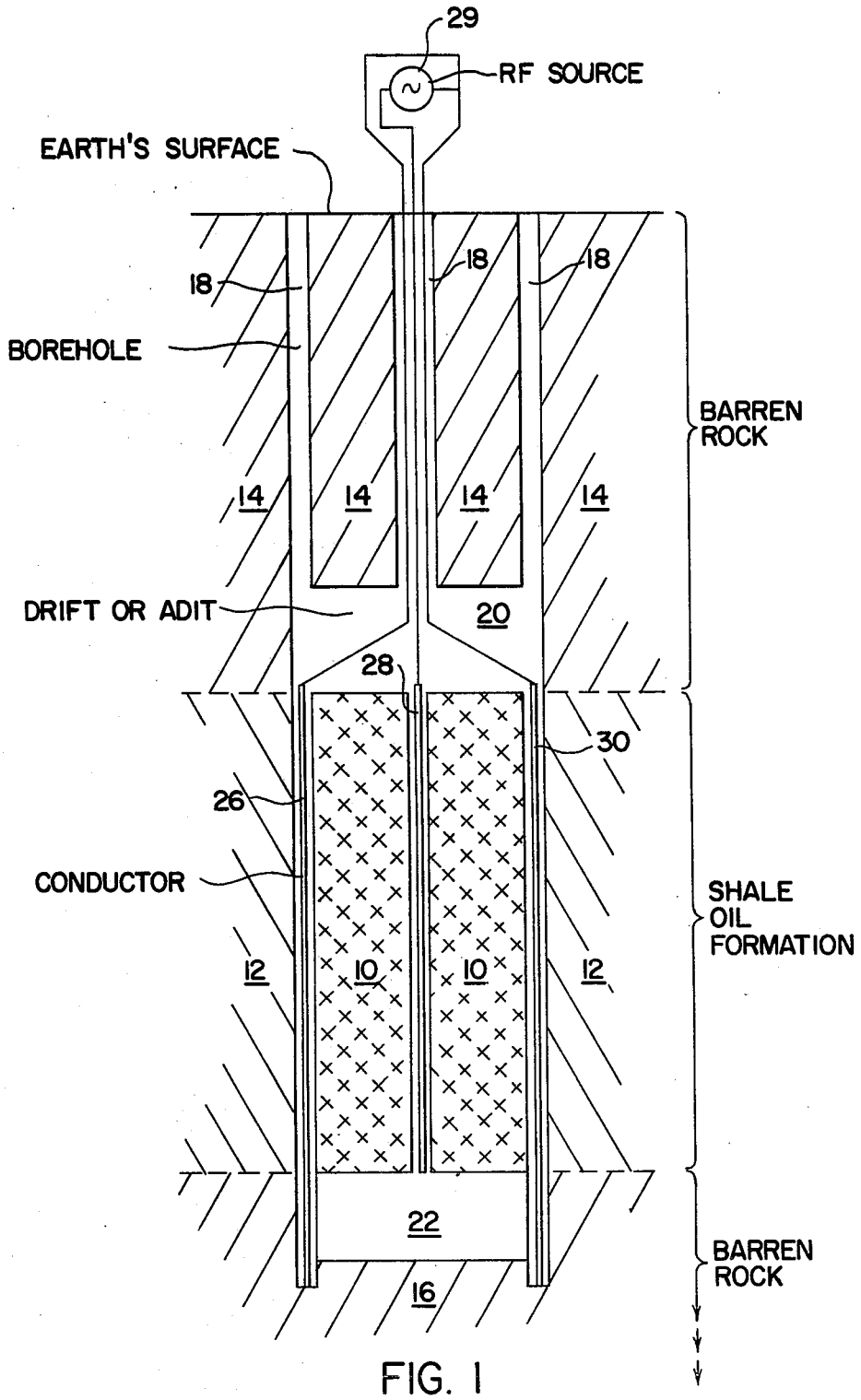
FIG. 1 is a cross sectional schematic view illustrating one technique for applying radio frequency energy to a subterranian rubblized bed in accordance with the inventive process, the illustration being made before rubblization.

In accordance with the present invention, valuable hydrocarbonaceous products are recovered from hydrocarbonaceous earth deposits by destructively distilling the hydrocarbonaceous material in the earth deposits and recovering the hydrocarbonaceous product produced by the destructive distillation. The present invention finds widest applicability in recovering shale oil from oil shale. The invention, however, can be practiced on any other hydrocarbonaceous earth deposit which is solid and not freeflowing, such as for example coal.

The present invention is a modification of the previously described IITRI technique. The IITRI technique is more fully described in the above-mentioned U.S. Pat. No. 4,144,935, the disclosure of which is incorporated herein by reference. This technique was also thoroughly described in a presentation made to the Eleventh Oil Shale Symposium, Colorado School of Mines, Apr. 1978 by Bridges, et al., entitled NET ENERGY RECOVERIES FOR THE IN SITU DIELECTRIC HEATING OF OIL SHALE.

Basically, the IITRI technique involves the generation of electrical excitations (usually in the radio frequency range) in a hydrocarbonaceous earth formation bed so as to establish alternating electrical fields substantially confined to the bed to thereby cause substantially uniform heating of the bed resulting in the destructive distillation of the hydrocarbonaceous material in the bed. More simply put, the IITRI technique involves the application of radio frequency energy to a shale oil bed to heat the bed to a temperature high enough so that the kerogen therein is destructively distilled. Appropriate selection of the shape of the electrodes, positioning of the electrodes and the application of the radio frequency energy allows the electrical field created to be maintained within the bed being processed to a remarkable degree. This makes the process relatively efficient because the electrical energy is not wasted on areas not being processed.

For convenience, the following discussion will refer only to the recovery of shale oil from oil shale by the application of radio frequency energy to the oil shale. It will be appreciated, however, that the following discussion applies equally as well to processing any other solid non-freeflowing hydrocarbonaceous deposit and to using electrical excitations other than those with frequencies in the radio frequency range.

The inventive process is carried out in the same way as the IITRI process, except that in accordance with the present invention the shale oil bed to be processed is rubblized when the radio frequency energy is applied thereto. By "rubblized" and "rubblizing" is meant that the solid, non-freeflowing hydrocarbonaceous formation in the bed to be processed is broken-up into chunks or pieces (i.e. rubble) much smaller in size than the bed to be processed. The exact size of the chunks or pieces produced by rubblizing is not important, since any rubblization will cause some improvement. In general, however, the improvement realized in accordance with the invention will increase in magnitude as the extent of rubblization increases. Normally it is desirable to carry out rubblization so that at least 80% of the material in a bed rubblized has a maximum diameter of 4 to 6 feet.

Rubblization can occur by any technique known in the art, and is most conveniently carried out by explosion techniques. As is well known to those skilled in the art, rubblizing an oil shale formation by explosion techniques is very easily accomplished by drilling a number of holes in the formation and packing the holes with a suitable explosive such as a mixture of ammonium nitrate and petroleum and detonating the mixture.

In carrying out the inventive process, rubblization can occur at any time provided that the bed being processed is in a rubblized condition at least during part of the time in which radio frequency energy is being applied thereto. Normally, rubblization of a particular bed will occur prior to the application of the radio frequency energy since this is easiest, although it is possible to start the application of the radio frequency energy before rubblization, if desired.

After rubblization of the bed to be processed, radio frequency energy is applied to the bed and shale oil recovered therefrom in the same way as in the IITRI process.

In order to facilitate a further understanding of the invention, attention is directed to FIG. 1 which illustrates the application of the inventive process to a bed 10 of a shale oil formation 12 lying below an overburden 14 of barren rock and above a further formation 16 of barren rock. Bore holes 18 are drilled from the surface and a drift or adit 20 mined into the barren rock formation 14 above bed 10. In actual practice as taught in U.S. Pat. No. 1,144,935 rows of bore holes will be provided. After these bore holes are drilled, additional bore holes (not shown), are also drilled into bed 10 and these bore holes filled with an explosive material such as a mixture of ammonium nitrate and petroleum. A second drift or adit 22 is mined below bed 10 to accommodate the increase in volume of bed 10 when it is rubblized. Impact resistant conductors 26, 28 and 30 are inserted into bore holes 18, the conductors together preferably forming a triplate-type electrode. The conductors are connected to a radio frequency energy source 29 by means of co-axial lines 31 as shown in the figure. The explosive in the bore holes (not shown) is then detonated thereby causing shale oil in bed 10 to be rubblized. Radio frequency energy is applied by means of electrodes 26, 28 and 30 to the bed 10 and hydrocarbon gases and vaporous shale oil developed because of the destructive distillation of the kerogen recovered from bore holes 18 as well as the access drift (not shown) to drift or adit 22.

Figure 2:
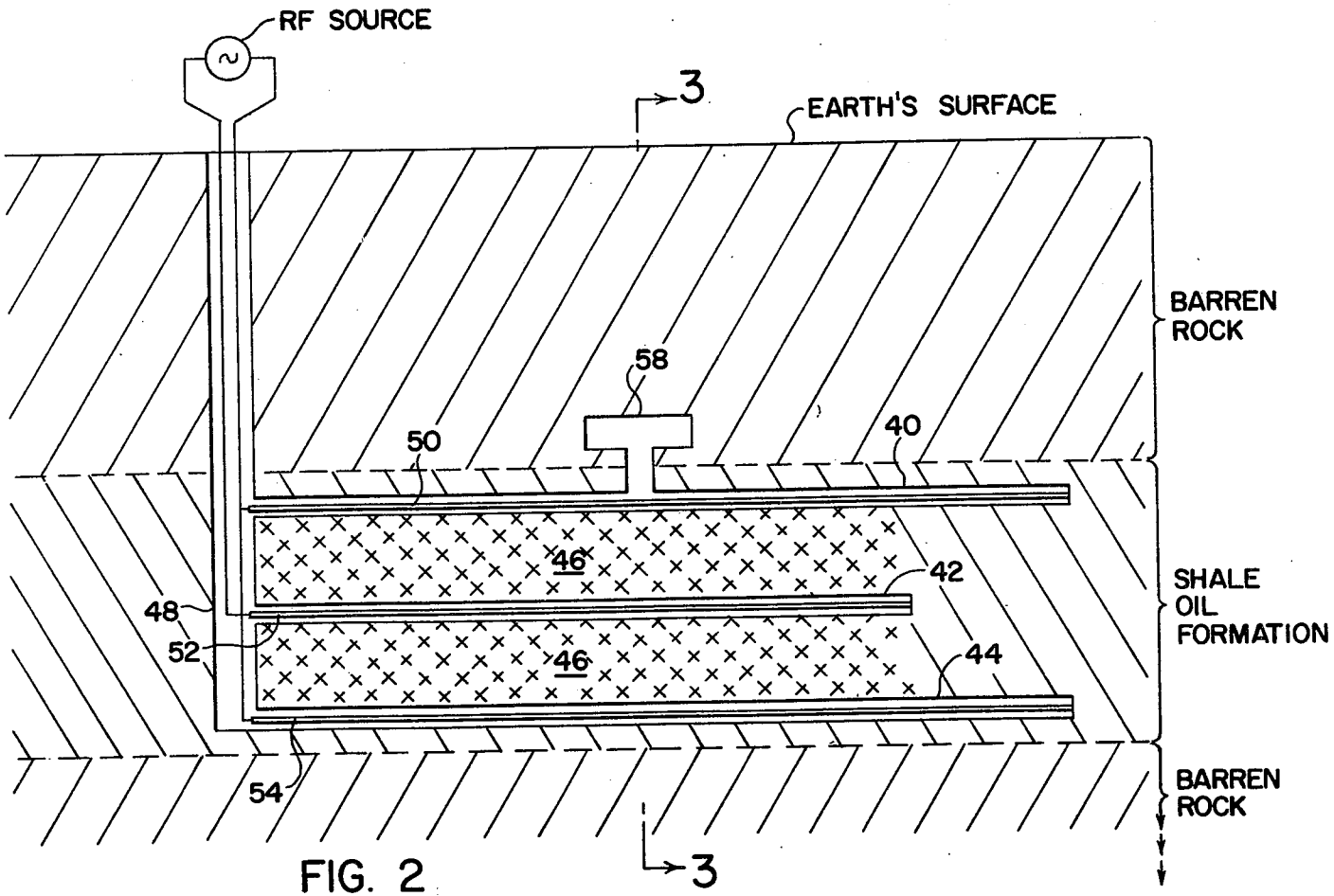
FIG. 2 is a cross-sectional schematic view similar to FIG. 1 and taken on line 2—2 of FIG. 3, which illustrates practicing the present invention using horizontally disposed electrodes rather than vertically disposed electrodes, the illustration also being made before rubblization.

Another technique for carrying out the inventive process is illustrated in FIG. 2. In this situation, mined intervals 40, 42 and 44 are made along the top and bottom and through the middle of a bed 46 of shale oil to be processed. Mined interval 42 is essentially coextensive with the length and breadth of bed 46 while mined intervals 40 and 44 are somewhat longer than bed 46 in order to accommodate longer conductors, as thoroughly described in the aforementioned U.S. Pat. No. 4,144,935. As is well known in the art of oil shale mining, it is necessary to leave approximately 25% of the oil shale present in a mined interval if the interval is larger than a certain size. It therefore may be necessary to leave some of the oil shale formation in mined intervals 40, 42 and 44 to act as pillars for supporting the roofs of the respective mined intervals.

Bore holes (not shown) for accommodating explosive material are then drilled into bed 46. These bore holes can be drilled horizontally from shaft 48, although it is preferred to drill these holes vertically upwardly and downwardly from mined interval 42. The bore holes are then filled with an explosive material, and conductors 50, 52 and 54 inserted into the mined intervals. In the preferred embodiment of the invention, conductors 50, 52 and 54 comprise metallic screens or meshes essentially coextensive with the mined intervals. Metallic screens or meshes are preferred since they are best able to accommodate impact and movement caused during rubblization of bed 46. Moreover, are preferred because they enable the electric field generated to be more nearly uniform in intensity reduce overall electrical power requirements by as much as 5% as compared with rows of spaced conductors. The explosive in bed 46 is then detonated to rubblize bed 46, and radio frequency energy applied in the same way as discussed above to cause destructive distillation of the kerogen and recovery of the hydrocarbon gas and vaporous shale oil.

Figure 3:
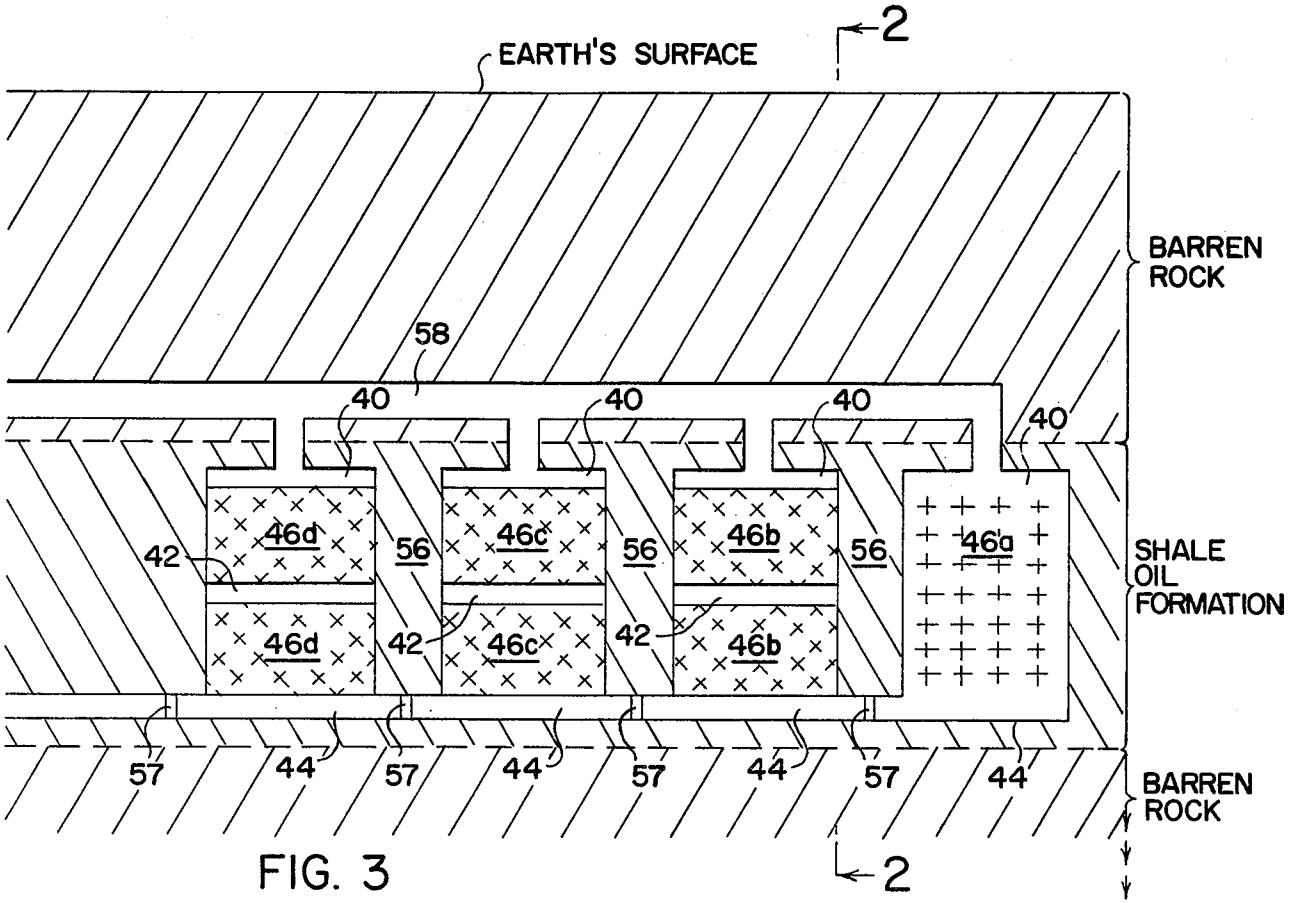
FIG. 3 is a cross-sectional schematic view taken on line 3—3 of FIG. 2 and illustrating carrying out the inventive process on a series of adjacent oil shale beds within the same oil shale formation.

The most preferred embodiment of the present invention is illustrated in FIG. 3. This figure depicts a plurality of shale oil beds **46*a*, 46*b*, 46*c* and 46*d* arranged next to one another and separated from each other by parts of the oil shale formation forming barrier panels 56 which are sealed with bulk heads 57. Above, in between and below beds 46 provided mined intervals 40, 42 and 44 as shown in FIG. 2, with the respective intervals 44 at the bottom of each bed communicating with one another through bulk heads 57. Above each bed 46 is also provided a tunnel 58 communicating with mined intervals 40 at the top of each bed. Suitable mechanical seals, ducts, pipes and valving means (not shown) are provided to enable gas flows to be maintained as described below. In the figure, bed 46*a* is shown after rubblization while beds 46*b*, 46*c* and 46*d* are shown before rubblization. Each of mined intervals 40, 42 and 44 is provided with metallic screen or mesh conductors (not shown) as described above in connection with FIG. 2**.

In operation, after rubblization of bed **46*a*, bed 46*a* is retorted by means of radio frequency energy, whereby hydrocarbon gas and vaporous shale oil in admixture are produced. This gas mixture is withdrawn from the bottom of bed 46*a* via the communicating mined intervals 44 and transmitted to the surface where it is cooled to condense the vaporous shale oil, which is recovered as product. The hydrocarbon gas remaining after condensation is preferably transferred via tunnel 58 back to bed 46***a* for another pass there through. By this means the product hydrocarbon gas serves to flush out incipiently formed vaporous shale oil and new hydrocarbon gas, thereby facilitating the recovery operation. Once a sufficient flow of recycle hydrocarbon gas is established, a portion of the hydrocarbon gas recycle is bled off and recovered as co-product.

After retorting is completed, air is injected via tunnel 58 to the top of bed 46*a* whereby the oxygen in the air reacts with carbon in the shale and increases the temperature of bed 46*a* considerably. Meanwhile, gas withdrawn from the bottom of bed 46*a* which is essentially oxygen-free due to the combustion in bed 46*a* is transferred, preferably with the aid of suitable vacuum pumps and blowers, to the bottom of bed 46*b* (which has been previously rubblized). The gas then passes through bed 46*b* where it heats the rubble therein and is taken off via tunnel 58 and discharged. Air continues to be supplied to the top of bed 46*a* until just before an oxygen breakthrough at the bottom of bed 46*a* is reached, at which time air flow is reduced so that the gas coming out of bed 46*a* will still be oxygen-free or teminated. Then oxygen-free gas is recirculated between beds 46*a* and 46*b* until the temperature of bed 46*b* is increased significantly over ambient, preferably until the temperatures of beds 46*a* and 46*b* are equal or almost equal.

At this time, gas flow through bed 46*b* is discontinued and radio frequency energy supplied to bed 46*b* to cause destructive distillation of the kerogen therein. The vaporous products therefrom again being withdrawn via the mined intervals 44. Meanwhile, bed 46*c* is rubblized and then hot gases are recirculated between beds 46*a* and 46*c* in order to recover some of the sensible heat still remaining in bed 46*a* to heat bed 46*c*. After retorting bed 46*b*, hot gases are recirculated between beds 46*b* and 46*c* and air supplied to bed 46*b* to further heat bed 46*c* prior to the application of radio frequency energy thereto in the same way bed 46*b* was initially heated. This procedure is repeated until all of the beds are processed.

As is clear from the above, a novel and important aspect of the present invention is that the shale oil bed to be processed with radio frequency energy is rubblized prior to the application of the radio frequency energy. This results in many advantages and allows the inventive process to generate high yields of shale oil much greater than the yields possible with the IITRI process as presently contemplated.

Thus, because rubblization causes breaking-up of the mass of oil shale into smaller chunks and the creation of fissures between the chunks, gas flow out of the oil shale bed as a whole is greatly facilitated. This, in turn, allows the oil shale bed as a whole to be heated-up at a relatively high rate while still maintaining a relatively low pressure. In view of the properties of shale oil as discussed above in the BACKGROUND OF THE INVENTION section, this combination of rapid heating and low pressure operation tends to maximize the production of shale oil.

Second, because of the high relative permeability of rubblized shale oil, incipiently formed shale oil can be removed from the shale oil bed relatively quickly by using an oxygen-free carrier gas to continuously flush out the oil shale bed during the retorting operation. This prevents breakdown of the shale oil and hence also tends to maximize the yields of shale oil available.

Third, because of the higher gas permeability in a rubblized shale oil bed, greater heat transfer by means of convection is possible. Because kerogen content in a shale oil formation varies significantly and because pyrolysis of shale oil is endothermic, leaner areas of the shale oil will heat up faster and hence hot spots will develop. This not only reduces yields of shale oil due to coking thereof but also wastes electrical energy since certain areas of the formation are heated hotter than necessary. Greater heat transfer through convection made possible by rubblizing essentially eliminates these problems.

Fourth, because a combustion front is not used for developing the last increment of heat necessary for retorting (i.e. the heat over and above the sensible heat recovered from other beds), problems associated with combustion fronts such as channeling and burning desired products are avoided.

Fifth, after retorting, the sensible heat of a retorted bed can be transferred very simply and easily to another bed to be retorted via forced convection, which is much faster than heat transfer via conduction as used in the IITRI process.

Sixth, if desired, air can be injected into a previously retorted bed to cause combustion of coke therein thereby further increasing the amount of sensible heat in the previously retorted bed for transfer to another bed by forced convection. By controlling the amount of air fed to the bed so that no oxygen passes out of the bed, combustion of hydrocarbon gas and shale oil in the next bed to be retorted can be avoided.

Seventh, because the inventive process is accomplished at essentially atmospheric pressure (as opposed to the IITRI process which is accomplished at an elevated pressure) chances of discharging potentially deadly gases to other parts of the mine where it could harm workers is much reduced.

From the above, it can be seen that by rubblizing the shale oil prior to application of radio frequency energy, it is possible to accomplish retorting of oil shale and recovery of shale oil therefrom in such a way that recovery of shale oil is maximized. Furthermore, by using a rubblization procedure, highly efficient convection techniques can be used to transfer sensible heat from a previously rubblized and retorted bed to another rubblized bed to be retorted. Together these aspects of the inventive process make it possible for the IITRI technique to be practiced so as to yield much higher amounts of shale oil, especially when processing larger shale oil beds, than ever possible before and to operate at much lower cost.

Although only a few embodiments of the present invention have been described above, it should be appreciated that many modifications can be made without departing from the spirit and scope of the invention. For example, although the foregoing description has shown that the conductors are inserted in the shale oil bed prior to rubblization, the electrodes can be inserted after rubblization if desired. This, however, is not preferred as it is much more difficult to drill and mine already rubblized material.

Furthermore, although a single triplate-type electrode system has been shown in each specific example of the inventive process as illustrated above, any other type of electrode system as generally described in the aforementioned U.S. Pat. No. 4,144,935 can be employed.

Furthermore, although the above description in connection with FIGS. 2 and 3 has shown the triplate electrodes to be composed of three conductors, any other odd number of conductors (other than one) in an arrangement could be used. Often times, a shale oil bed to be processed will be so thick that a single triplate-type electrode composed of three conductors will be inadequate to set-up electric fields of sufficient intensity. In this situation, five, seven or any other odd number of stacked, alternately charged electrodes can be used.

All such modifications are intended to be included within the scope of the present invention, which is to be limited only by the following claims:

I claim:

1. In a process for recovering hydrocabonaceous material from a solid non-freeflowing hydrocarbonaceous material bed in which said bed is heated in situ by applying radio frequency energy thereto to effect dielectric heating of said bed, the improvement wherein said bed is rubblized prior to the application of radio frequency energy thereto, said radio frequency energy being applied by means of conductors inserted into said bed prior to rubblization.

2. The process of claim 1 wherein radio frequency energy is applied to said hydrocarbonaceous material by means of conductors comprising metal screens or meshes.

3. The process of claim 2 wherein said hydrocarbonaceous material is rubblized such that at least 80 percent thereof has a maximum diameter of 4 to 6 feet.

4. The process of claim 1 wherein said hydrocarbonaceous material is rubblized such that 80 percent thereof has a maximum diameter of 4 to 6 feet.

5. In a process for recovering a hydrocarbonaceous product from a solid non-freeflowing hydrocarbonaceous earth formation in which a bed of said hydrocarbonaceous earth formation is heated in situ to cause destructive distillation of hydrocarbonaceous material therein to form said hydrocarbonaceous product, heating of said bed being accomplished by introducing electrical excitation into said bed to establish alternating electric fields in said bed, said alternating electric fields being substantially non-radiating and being substantially confined in said bed, whereby dielectric heating of said bed occurs, the improvement wherein said bed is rubblized prior to the application of said alternating electric fields in said bed, said electrical excitation being introduced into said bed by means of conductors inserted into said bed prior to rubblization.

6. The process of claim 5 wherein said hydrocarbonaceous earth formation is oil shale and said hydrocarbonaceous product is shale oil.

7. In a process for recovering shale oil from a bed of oil shale in which said bed of oil shale is heated in situ to cause destructive distillation of the kerogen therein by the application of radio frequency energy thereto, and the shale oil produced thereby recovered from said bed, the improvement wherein said oil shale is rubblized prior to the application of said radio frequency energy thereto, said radio frequency energy being applied by means of conductors inserted into said bed prior to rubblization.

8. The process of claim 7 wherein radio frequency energy is applied to said bed by means of a plurality of conductors arranged to form a triplate-type electrode.

9. The process of claim 8 wherein said conductors are horizontally arranged.

10. The process of claim 9 wherein said conductors are metal screens or meshes.

11. The process of claim 7 wherein said radio frequency energy is applied by means of conductors comprising metal screens or meshes.

12. The process of claim 7 wherein said oil shale is rubblized such that 80 percent thereof has a maximum diameter of 4 to 6 feet.

13. The process of claim 7 wherein said oil shale is rubblized by explosion techniques.

14. A process for recovering shale oil from an oil shale formation defining a plurality of oil shale beds, said process comprising:

(1) rubblizing a first oil shale bed, (2) thereafter heating said first oil shale bed in situ to cause destructive distillation of kerogen therein and the generation of vaporous shale oil, heating of said first shale oil bed being at least partially accomplished by applying radio frequency energy thereto by means of conductors inserted into said bed prior to step (1), (3) recovering vaporous shale oil from said first shale oil bed, (4) rubblizing a second shale oil bed, (5) after step (2), transferring sensible heat in said first shale oil bed to said second shale oil bed by forced convection, and (6) heating said second shale oil bed in situ by the application of radio frequency energy thereto to cause destructive distillation of the kerogen therein and the generation of additional vaporous shale oil, said radio frequency energy being applied by means of conductors inserted into said second shale oil bed prior to rubblization thereof.

15. The process of claim 14 wherein rubblization of said second shale oil bed is accomplished after application of radio frequency energy to said first shale oil bed.

16. The process of claim 14 wherein rubblization of said second shale oil bed is accomplished before application of radio frequency energy to said first shale oil bed.

17. The process of claim 14 further comprising:

(7) recovering said additional vaporous shale oil, (8) rubblizing a third shale oil bed, and (9) after step (5), transferring sensible heat still remaining in said first shale oil bed to said third shale oil bed by convection.

18. The process of claim 17 wherein radio frequency energy is applied to said shale oil beds by means of horizontally arranged conductors.

19. The process of claim 18 wherein said horizontally arranged conductors form triplate-type electrodes.

20. The process of claim 14 wherein radio frequency energy is applied to said shale oil beds by means of horizontally arranged conductors.

21. The process of claim 20 wherein said horizontally arranged conductors form triplate-type electrodes.

22. A system for in situ heat processing of hydrocarbonaceous earth formations comprising:

conductive means inserted in said formation and electrically bounding a particular bed of said formation on at least two sides thereof;

electrical excitation means for establishing alternating electric fields in said bed, the frequency of said excitation means being selected as the function of the bed dimensions so as to establish substantially non-radiating electric fields which are substantially confined in said bed whereby volumetric dielectric heating of the formations will occur to effect approximately uniform heating of said bed; and means for rubblizing said bed in situ.

23. The system of claim 22 wherein said conductive means comprises metallic screens or meshes.

24. The process of claim 23 wherein said oil shale beds are rubblized such that at least 80 percent thereof has a maximum diameter of 4 to 6 feet.

25. The process of claim 14 wherein radio frequency energy is applied by means of conductors comprising metal screens or meshes.

26. The process of claim 25 where said oil shale is rubblized such that at least 80 percent thereof has a maximum diameter of 4 to 6 feet.

27. The process of claim 14 wherein said oil shale beds are rubblized such that at least 80 percent thereof has a maximum diameter of 4 to 6 feet.

* * * * *